United States Patent [19]

Klepper et al.

[11] 4,027,313

[45] May 31, 1977

[54] PHOTOCOMPOSING MACHINE AND FONT STRIP THEREFOR FOR KERNED CHARACTERS

[75] Inventors: Herbert Klepper, Brooklyn; Walter Hansen, Cold Spring Harbor; Joel S. Harris, Valley Stream; Farrokh Golesorkhi, Commack, all of N.Y.

[73] Assignee: Eltra Corporation, New York, N.Y.

[22] Filed: June 18, 1975

[21] Appl. No.: 587,856

[52] U.S. Cl. ..... 35415; 354/11; 354/19

[51] Int. Cl.[2] ..... B41L 13/08

[58] Field of Search ..... 354/6, 11, 14, 15, 16, 354/19, 12, 13, 292

[56] References Cited

UNITED STATES PATENTS

| | | | |
|---|---|---|---|
| 3,336,849 | 8/1967 | Broglio | 354/14 |
| 3,643,559 | 2/1972 | Mayroud | 354/13 |
| 3,710,707 | 1/1973 | Hanson et al. | 354/14 |
| 3,731,610 | 5/1973 | Kyte | 354/6 |
| 3,768,384 | 10/1973 | Mason | 354/15 |
| 3,893,132 | 7/1975 | Ebner | 354/13 |

*Primary Examiner*—Edna M. OConnor
*Attorney, Agent, or Firm*—Brumbaugh, Graves, Donohue and Raymond

[57] ABSTRACT

A photocomposing machine and font strip therefor are described which allow type designers to have the flexibility to design typographical characters which are kerned. The photocomposing machine is able to automatically kern those characters which are designed to be kerned. The automatic kerning is accomplished by intentionally offsetting each character's placement on the font strip to the left with respect to the machine's aperture, and providing an optical system in the photocomposing machine which intentionally offsets the projection of the font strip through the aperture of the machine to the right, thereby cancelling the offset of unkerned characters. Kerned characters are placed to the right on the font strip in order to allow the machine's optical system offset to overlap the image of kerned characters on the space normally reserved for the next character.

19 Claims, 19 Drawing Figures

STATIONARY 21 UNIT APERTURE
VARIABLE SPACING

VARIABLE WIDTH APERTURE

PHOTOCOMPOSING MACHINE AND FONT STRIP THEREFOR FOR KERNED CHARACTERS

BACKGROUND OF THE INVENTION

The present invention relates to a method and apparatus for automatically kerning type set on a photocomposing machine.

The printing industry has been undergoing a technological change from type set using brass strips as a mold for molten lead, to the use of photocomposing machines for photographically setting galley sheets which are then pasted up and used in a photo-offset process. In undergoing this change, some of the artistry formerly associated with the typesetting process was abandoned in the effort to automate the equipment. The desire to provide automatic machines having replaceable font strips conflicted with the flexibility associated with manual typesetting. Maximizing the utility of the machines has lead to design constraints related to the format of font strips and the aperture size and location within the machine.

Heretofore, these design constraints have made automatic kerning of type set on photocomposing machines unwieldy and have imposed undesirable constraints upon type designers in addition to complex constraints upon the format of font strips.

In a photocomposing machine using drum-mounted font strips, it is desirable to maximize the number of characters per font strip while minimizing the size of font strips so that the access time for each character is minimized without increasing the peripheral drum velocity. The basis for these constraints is the fact that the drum continues to rotate while characters are being strobed onto a print-receiving medium. The discharge lamps used in photocomposing machines are designed to have a minimal flash duration to decrease the amount of smear of the character due to drum movement. Any increase in drum peripheral velocity leads to an increase in character smear, resulting in an unaesthetic output. Heretofore, these constraints reduced the flexibility of type designers and consequently eliminated much of the artistry associated with typesetting when a photocomposing machine, rather than hot type, was used.

SUMMARY OF THE INVENTION

The present invention provides a method and apparatus for laying out type on a font strip which allows a type designer to kern desired characters to a greater or lesser extent depending upon the width of the characters. The result is obtained by effectively misplacing the characters on the font strip. Apparatus associated with the photocomposing machine detects characters having a size greater than a predetermined size and optically moves such characters to correct for misplacement on the font strip. The invention thereby allows virtually complete design freedom to type designers and at the same time provides a reduction in the size of a font strip having a given number of characters.

According to the present invention, a phototypesetting machine is provided which uses a character carrier comprising an elongated strip of material having a longitudinal succession of elements disposed thereon. One longitudinal succession of elements are typographical characters and the other, associated, succession of elements are timing marks. The timing marks and typographical characters have an optical transmissivity opposite that of the remaining portion of the character carrier. The typographical characters are arranged along a common base line extending longitudinally. The placement of the right side bearings of each typographical character is determined by the character width such that all characters having a width equal to or less than a prescribed width have a right side bearing horizontally displaced from the timing mark associated with the character by a first predetermined interval. Typographical characters having a width greater than the prescribed width have their right side bearings displaced to the right with respect to the first predetermined interval by an amount substantially equal to the difference between the character's width and the first prescribed width.

In a preferred embodiment, the characters may be kerned, which means that they intrude beyond their right side bearings as desired by the type designer. The phototypesetting machine positions characters based upon their prescribed width rather than upon their placement or kern, if any, with respect to their right side bearing. Accordingly, the type designer is afforded discretion with respect to character kerning, limited only by the difference between the maximum width of the aperture in the optical system of the typesetting machine and the maximum character width of a typographical character. This limitation means that characters having the maximum assigned width are not kernable by an amount corresponding to the difference between the assigned width and the maximum permissible width.

Also described herein are various alternative embodiments of the basic invention in which kerning is made available to the type designer.

In one embodiment, a dual position aperture is used. In that embodiment, timing marks are associated with all typographical characters in a fixed relationship to the right side bearing of each character. Accordingly, kerned characters, which extend beyond their right side bearings, would be masked by an aperture which remains stationary. A memory associated with each font strip is plugged into the machine when the font strip is inserted therein and indicates to the machine's electronics that a kernable character has been selected. The selection of a kernable typographical character causes the aperture to be moved to the right in order to allow the kerned portion, if any, of the character to pass through the aperture, and to mask out the kern, if any, of an adjacent character.

Another embodiment which avoids the use of a multipositioned aperture, but which requires a longer font strip for the placement of the same number of characters, is also described. In that embodiment, a wider aperture is used which allows the image of either a kerned or an unkerned character to pass through. This embodiment requires greater separation of characters on the font strip in order to prevent the image of an adjoining, unselected, character from exposing the print receiving medium, but avoids the need for memories and other special electronic controls.

A slightly modified version of the preceeding embodiment which saves some space on the font strip at the expense of freedom given the type designer uses a fixed size, wide aperture with variable spacing of typographical characters on the font strip. The font strip must be laid out to allow for separation between characters corresponding to the width of the aperture.

Therefore, narrower characters do not take up as much room on the font strip as do wide characters.

Yet another embodiment of the present invention uses variable spacing of characters on the font strip in order to place the maximum number of characters on a given font strip. In order to mask adjoining characters, the optical system of the machine is provided with a variable width aperture. In order to maximize the number of characters per font strip, timing marks are aligned with the rightmost portion of all character and kerning is accomplished by electronic control of the optical system.

DETAILED DESCRIPTION OF AN EXEMPLARY EMBODIMENT

Figure 1:
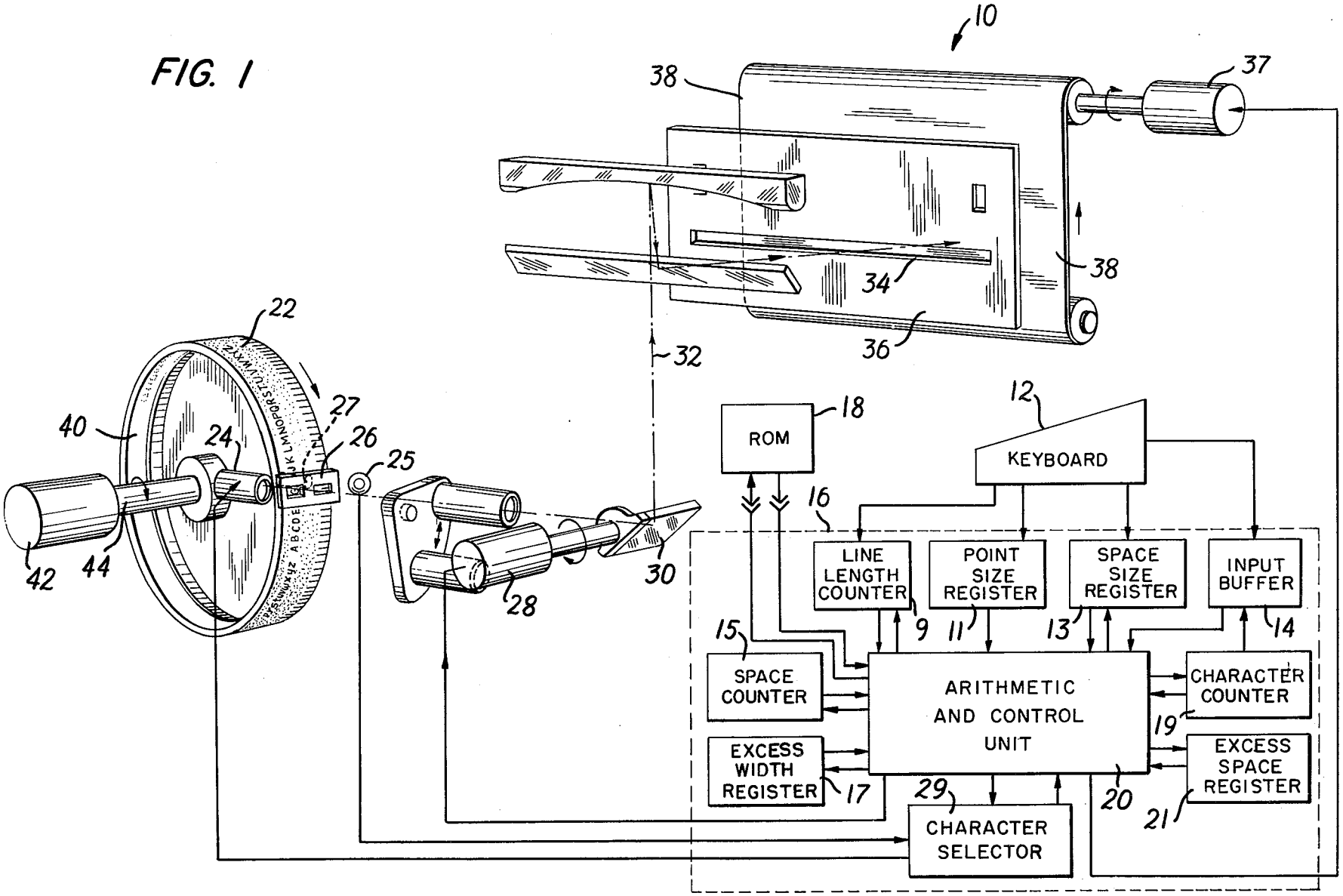
FIG. 1 is a pictorial and block diagram of the preferred embodiment of the phototypesetting machine of the present invention.
Figure 2:
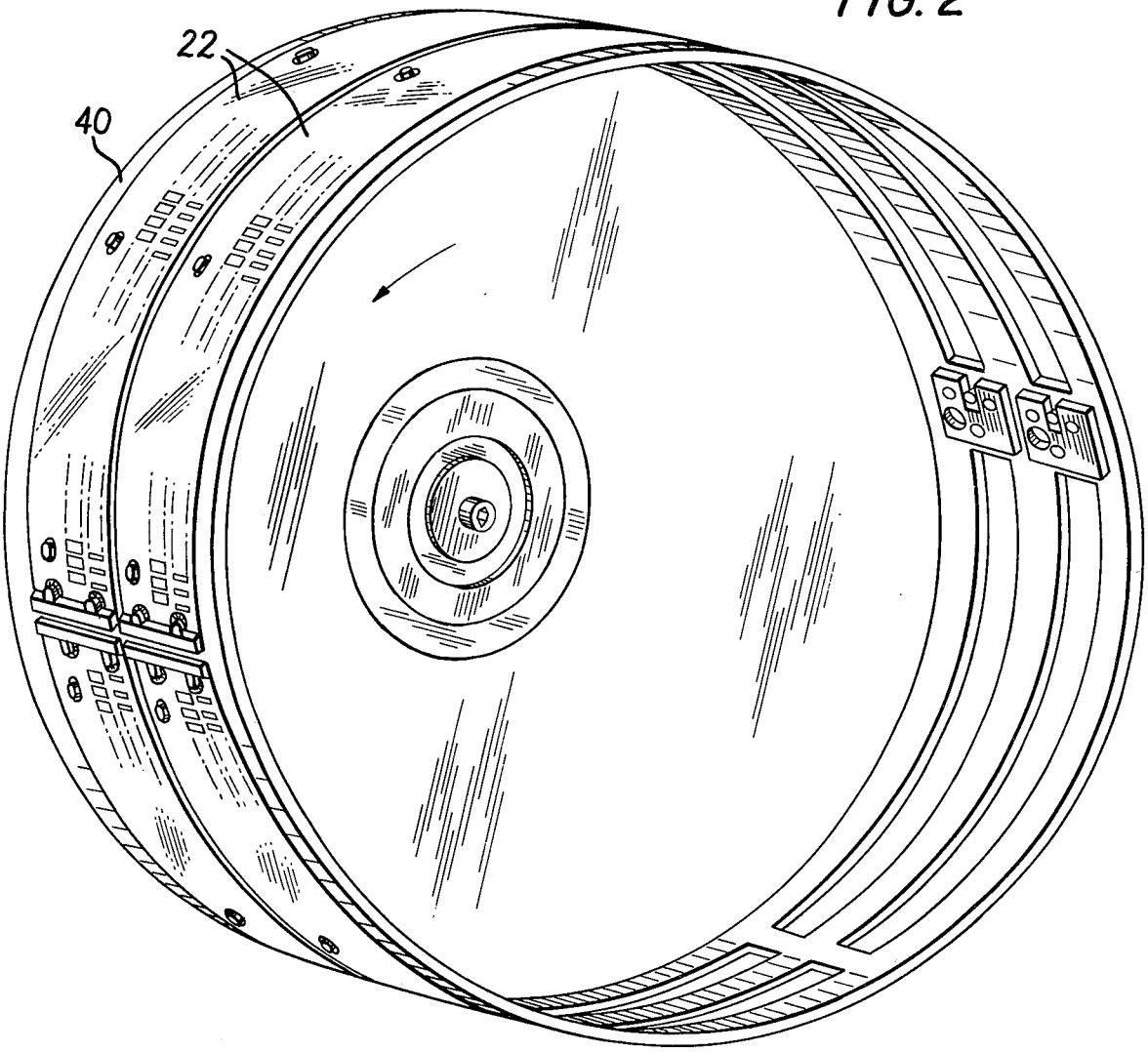
FIG. 2 is a pictorial drawing of the drum of the phototypesetting machine of FIG. 1 with font strips attached thereto.

Referring generally to FIG. 1, a pictorial and block diagram of a phototypesetting or a photocomposing machine 10 including the preferred embodiment of the present invention is shown.

The photocomposing machine 10 is operated in substantially the same manner as conventional photocomposing machines in that an operator at a keyboard 12 provides typographical input to a processing unit 16 which electronically controls character selection from a rotating font strip 22 by flashing a discharge lamp 24 as each selected character passes between the discharge lamp 24 and an aperture 26 of the optical system. The characters, which are stored in an input buffer 14, are accessed by counting timing marks adjacent to each character on the font strip. Counting is made possible by lamp 27 and an associated photocell 25 connected to a character selector circuit 29 within the processing unit 16.

A mirror stepping motor 28, also controlled by the processing unit 16, serves to alter the angle of a rotating mirror 30 thereby advancing character images 32 along a print receiving medium 38. The optical scanning system, used for controlling character placement, is more fully described in U.S. Pat. No. 3,881,801 issued to E. W. Bechtold on May 6, 1975 entitled "Optical Scanning System" which is assigned to the assignee of the present invention. Briefly, images 32 are advanced along a horizontal line within a slit 34 in a mask 36 to set horizontal lines of type on the print receiving medium 38. The print receiving medium 38 moves in vertical steps controlled by a paper stepping motor 37 for setting successive lines of type.

For reasons which will become apparent in the following description of the operation of the machine 10, there are also provided a series of registers called the line length counter 9, the point size register 11, the space size register 13, a space counter 15, an excess width register 17, a character counter 19, and an excess space register 21. These registers hold numbers which are used by the machine in setting lines of type, and they will be fully explained hereinafter.

In the preferred embodiment of the invention, a read only memory, or ROM 18, is associated with each font strip 22. The purpose of the ROM 18 is to provide character width information to an arithmetic and control unit 20 within the processing unit 16, as will be more fully explained hereinafter.

Referring generally to FIGS. 1 through 4, the font strip 22 is mounted on a drum 40 attached to the shaft 44 of a motor 42 which continuously rotates at high speed. In the preferred embodiment of the present invention, each drum 40 has four font strips 22 attached to it in a manner more fully described in U.S. Pat. No. 3,921,182 issued to W. Hansen et al. on Nov. 18, 1975, entitled "Font Strip and Retaining Mechanism for a Photocomposing Machine" which is assigned to the assignee of the present invention.

While in actual practice the adjacent positioning of two sets of parallel font strips 22 requires either that the motor shaft 44 be adapted for controlled reciprocal movement as well as continuous rotation, or, alternatively, that the motor be mounted on a reciprocating motor mount, in order to simplify the description of the preferred embodiment, of the present invention, the embodiment of FIG. 1 will be described with reference to a single font strip 22. The expansion to four font strips can be accomplished by one skilled in the art having a knowledge of the present invention and the invention described in the two U.S. patents referred to above, the subject matter of which is incorporated herein by reference.

Figure 3:
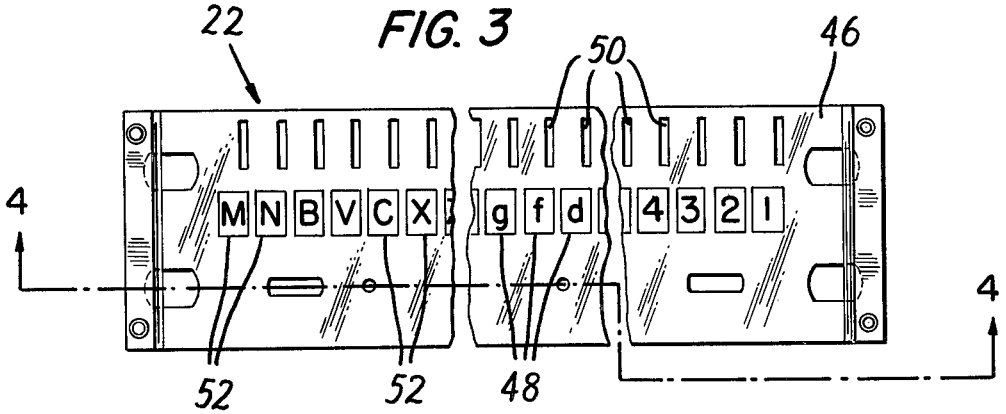
FIG. 3 is a schematic and pictorial representation of the preferred embodiment of the font strip of the present invention.
Figure 4:
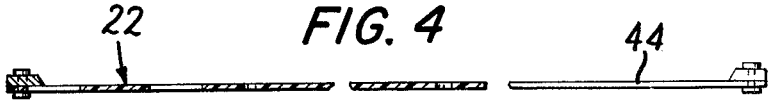
FIG. 4 is a cross-sectional view of the font strip of FIG. 3 taken along the line 4—4 of FIG. 3.

Referring generally to FIG. 3, each font strip 22 comprises a character carrier 46 preferably made of a plastic material such as a photographic film. On each character carrier 46, there are a series of two longitudinal successions of elements, including typographical characters 48 and their associated timing marks 50, each having an optical transmissivity opposite to that of the remaining portion of the character 46.

The font strip 22 shown in FIG. 3 is a schematic representation of an actual font strip in that it contains a series of boxes called em squares 52 which are used in positioning the typographical characters 48 with respect to their associated timing marks 50. The font strip 22 is also a schematic representation in that the optical transmissivity of the typographical characters 48 and the timing marks 50 are actually both opposite to that of the remaining portion of the character carrier 46 rather than as shown (for the purpose of clarity).

Figure 5:
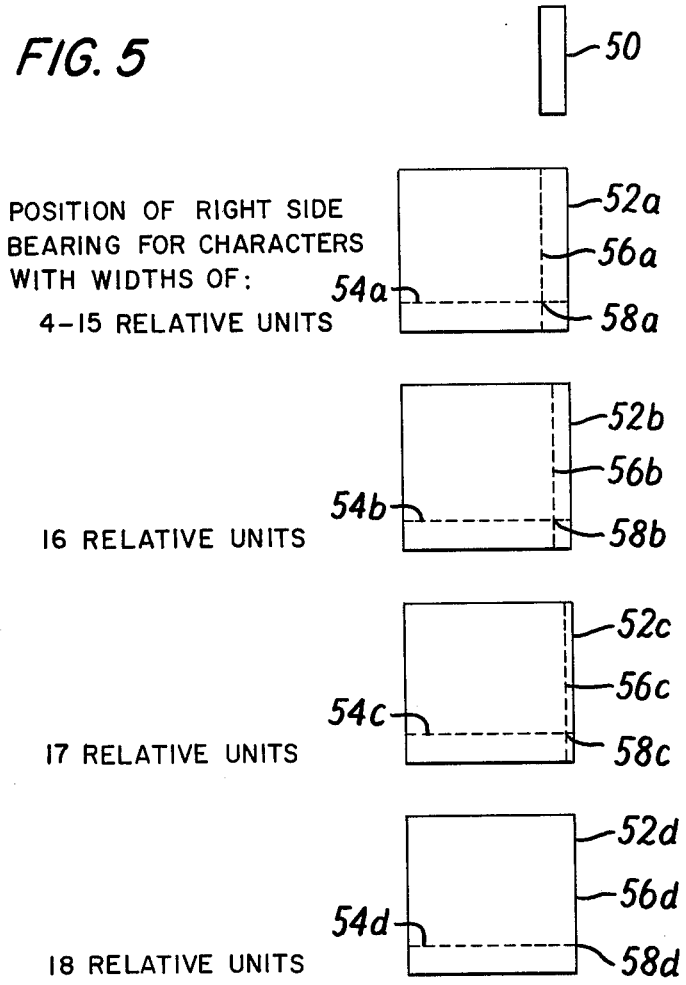
FIG. 5 shows a series of "em" squares, from the font strip of FIGS. 3 and 4, each having a right side bearing displaced from the edge of the em square by an amount corresponding to the size of characters to be placed within each of the em squares.

Referring now generally to FIG. 5, a single timing mark 50 is shown in vertical alignment with a series of em squares 52*a*, 52*b*, 52*c*, 52*d*. In designing a font of type to be used with the present invention, a type designer divides an em square into eighteen relative units. The width of various characters within a particular font is then established by the designer such that the widest character, generally "M" or "W," occupies the full horizontal width of the em square.

The em squares each include a "z-line" 54*a*, 54*b*, 54*c*, 54*d*, which is the line that the letter "z" normally sits on. Certain other letters, such as "g" or "y" normally extend below the z-line.

A vertical line, called the "right side bearing" 56*a*, 56*b*, 56*d*, is shown to intersect each z-line at the so-called "z-point" 58*a*, 58*b*, 58*c*, 58*d*. The right side bearing 56*a*, 56*b*, 56*c*, 56*d* defines the rightmost position of any part of an unkerned character within an em square. If all characters could be aesthetically placed within em squares with their rightmost extension within the right side bearing of the em square, there would be no need for kerning. However, it has been found that certain character combinations, notably "fi" or "ffi," result in an unaesthetic layout unless one character encroaches upon the space normally assigned solely to the adjacent character. This encroachment, called kerning, is the result of placing the rightmost side of the character on the left beyond its right side bearing.

In the preferred embodiment of the present invention, the right side bearing of a character is normally displaced by three relative units, one-sixth of an em, from the right side of the em square. The em square is aligned with the aperture in the optical system when its associated timing mark is aligned with the photocell used for character selection. Generally, the projection of the full em square encroaches upon the space allocated to the following em square on the print receiving medium by three relative units. However, the portion of the em square located to the right of the right side bearing does not generally appear on the print receiving medium for an unkerned character, because the character does not extend beyond the right side bearing of its em square. On the other hand, a kerned character will be so placed in the em square that it extends beyond its right side bearing, and its image will appear on the print receiving medium with the kerned portion extending into the space allocated to the next succeeding character.

In general, the electronics associated with the optical system compensates for the displaced position of the right side bearing by advancing the mirror 30, which projects character images 32 onto the print receiving medium 38, by a number of units corresponding to the width of the character before a character is flashed. All characters having widths of fifteen relative units or less are treated in a like manner, that is, the mirror 30 is stepped to advance character images in a horizontal direction corresponding to character width in relative units prior to the projection of the character onto the print receiving medium 38. Therefore, the image of any kerned character will encroach upon the space allocated to the next character to be selected, because the mirror 30 will advance only by the width of the character portion of the em square to the left of its right side bearing prior to flashing the next character onto the print receiving medium 38.

With continued reference to FIG. 5, the position of the right side bearing within an em square is represented for characters having various widths. In particular, the right side bearing 56*a* for characters having widths between four and fifteen relative units is located three relative units from the right side of the em square 52*a*; the right side bearing 56*b* for characters having widths of 16 relative units is displaced two relative units from the right side of the em square 52*b;* the right side bearing 56*c* for characters having widths of seventeen relative units is displaced one relative unit from the right side of the em square 52*c;* and the right side bearing 56*d* for characters having widths of 18 relative units coincides with the right side of the em square 52*d*. The area within each em square to the right of the right side bearing represents the amount by which a character having an assigned width corresponding to that particular em square may be kerned.

Figure 6:
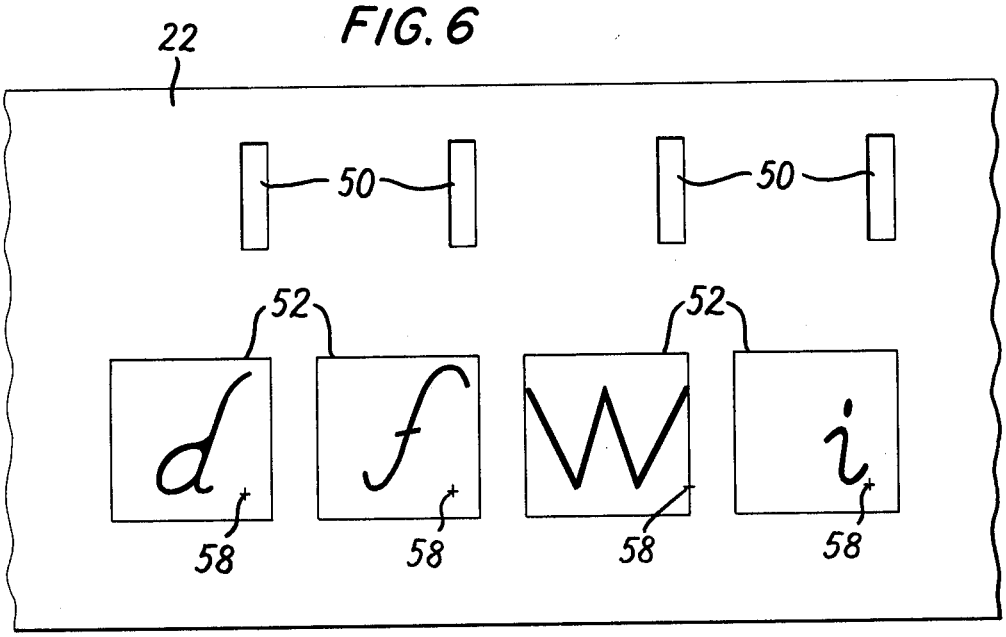
FIG. 6 shows a portion of the font strip of FIGS. 3 and 4 with a series of em squares, each having a character placed therein.

Referring now to FIG. 6, a portion of a font strip 22 with a series of em squares 52 having z-points 58 is shown. There is a character is each em square 52 with a width corresponding to the position of the right side bearing, as represented by the z-point of the em square. The characters "d", "f", and "i" each have widths of 15 relative units or less, and the character "w" has a width of 18 relative units. For the particular type design shown in FIG. 6, the "d" is kerned one relative unit, the "f" is kerned two relative units and the "w" and "i" are unkerned.

Characters having widths greater than fifteen units have their right side bearings, as represented by their z-points 58, closer to the right side of their em squares than do narrower characters. Accordingly, the flexiblility afforded to the type designer with regard to kerning of characters having widths greater than 15 relative units is somewhat decreased. In particular, a character having a width of 16 relative units may be kerned only two relative units; a character having a width of 17 relative units may be kerned only one relative unit; and a character having a width of 18 relative units may not be kerned.

The other compensation which is made in the present invention for characters having widths of greater than 15 relative units relative to the movement of the mirror 30. For characters having widths greater than 15 relative units, the mirror 30 is stepped first to advance on the character image 32 by 15 relative units in order to move the projection beyond the space allocated to the preceding character; then the character is flashed, and then the mirror is moved to advance the character image 32 by the excess width over fifteen relative units in order to prepare for the next succeeding character. For example, prior to flashing a character having a width of 17 relative units, the mirror 30 will be stepped to advance the character image by 15 relative units. Following the flash of the character, the mirror 30 will again be stepped to advance the character image by two relative units in preparation for the next character.

The movement of the mirror 30 to advance character images 32 by two relative units ensures that when the mirror 30 is advanced in preparation for flashing the next following character, the left edge of its character space will be aligned with the right side bearing of the character having the seventeen unit width. Naturally, if the seventeen unit wide character is kerned, its projection would encroach into the space reserved for the next following character.

Figure 7:
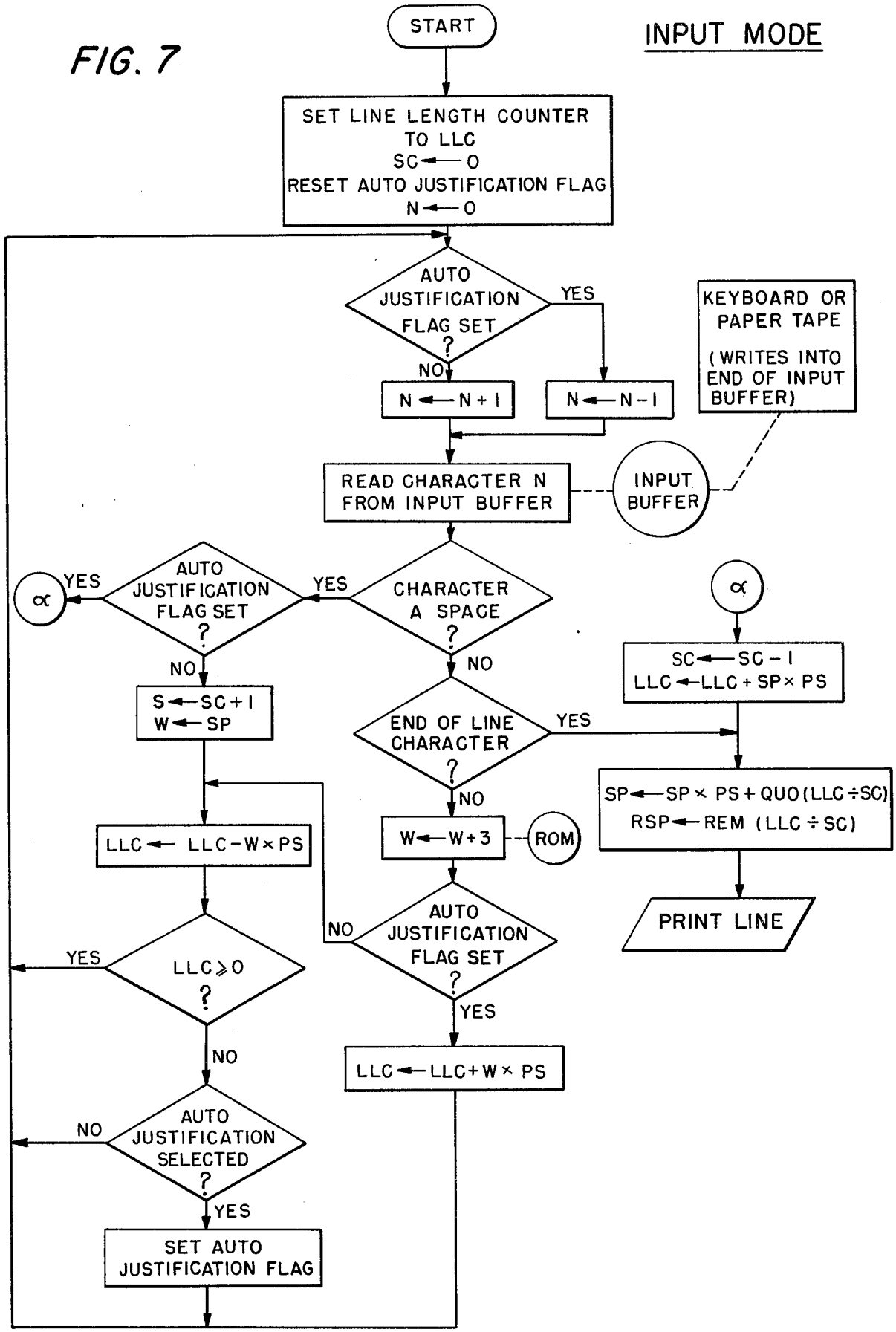
FIG. 7 is a flow chart which explains the operation of the preferred embodiment of the machine in the input mode.

The input mode of the photocomposing machine 10 is generally described in the flow chart of FIG. 7. Certain information must be provided by the operator for the machine to operate in the input mode. The required information includes the horizontal length of the line to be set (hereinafter called "LLC") which is placed into the line length counter 9, the minimum interword space width (hereinafter called "SP") which is placed in the space size register 13, and the type point size (hereinafter called "PS") which is placed into the point size register 11. The operator also determines whether the machine is to automatically justify right hand margins.

The following discussion assumes that the operator has supplied the required information to the machine and instructed that right hand margins are to be justified automatically. Initially, the machine sets LLC equal to the line length chosen by the operator, and initializes the number (hereinafter called "SC") in the space counter 15 to zero.

Typographical information is entered into the photocomposing machine 10 by means of a keyboard 12 or a paper tape reader (not shown). The characters entered are placed serially into the input buffer 14 which, in the preferred embodiment, has a capacity of 256 characters. Two characters which are of special interest to the machine, because they alter the layout of a given line, are an interword space and an end-of-line character.

Characters may be placed in the input buffer by the keyboard 12 or the paper tape reader while the machine is making calculations relating to setting up a line to be printed. In accordance with the flow chart of FIG. 7, characters are removed from the input buffer serially. If a character is neither an interword space nor an end-of-line character, the character's width is obtained from the ROM (remembering that three is added to the number contained in the ROM to obtain the character's width, W). Then, LLC is decremented by W 33 PS. Thereafter, the next chararacter is read from the input buffer 14.

If the character read from the input buffer 14 is an interword space, the minimum space width, SP, is used as the character's width, W, and LLC is decremented by SP × PS.

If the character read from the input buffer 14 is an end-of-line character, the machine computes the actual interword space size, SP, by dividing LLC, which is a number corresponding to the excess spaces left in the line, by SC, which is the number of interword spaces in the line. If the division of LLC by SC results in a remainder, the number of remaining spaces (hereinafter called "RSP") is stored in the excess space register 21. The remaining spaces will be assigned one at a time, serially from the beginning of the line, until no spaces remain.

If the operator has selected automatic justification, it is not necessary for him to insert any end-of-line characters in lines which are to be automatically justified. Accordingly, the machine continues to remove characters from the input buffer 14, one character at a time, and adds back to LLC the width of each character which had previously been subtracted from LLC. The backtracking continues until the first interword space is reached.

When the machine reaches the first interword space, it decrements SC by one, increments LLC by SP × PS, and calculates both the actual space size, Sp, and RSP. The machine then transfers to the print mode.

If, on the other hand, an end-of-line character is read from the input buffer 14, the machine immediately calculates both the actual space size, SP, and RSP, and then it transfers to the print mode.

It will be understood by one skilled in the art that the operation of the machine in the input mode shown in FIG. 7 is entirely conventional.

Figure 8:
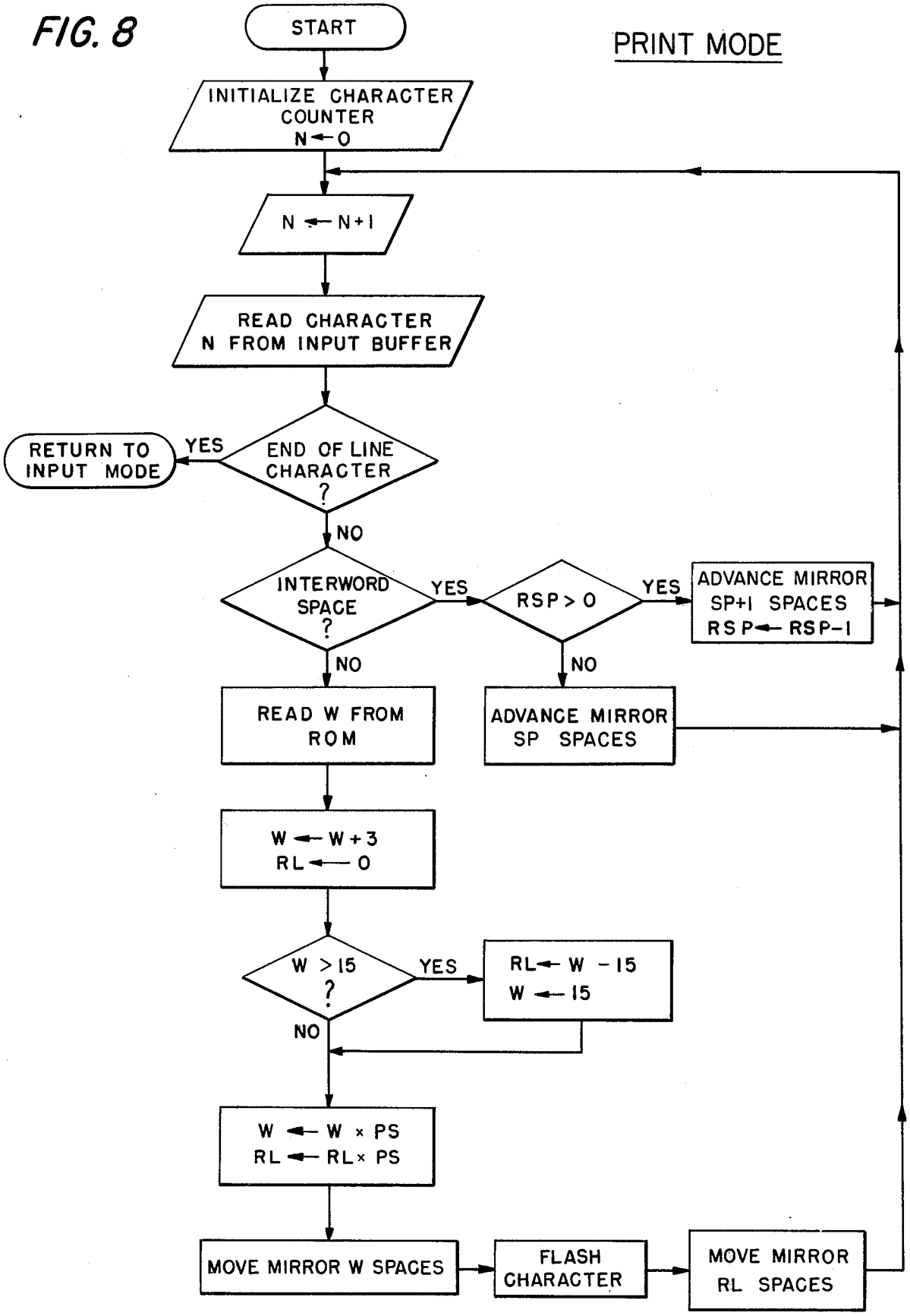
FIG. 8 is a flow chart which explains the operation of the preferred embodiment of the machine in the print mode.

Referring now generally to FIG. 8, a flow chart of the print mode is shown. The number (hereinafter called "N") in the character counter 19 is initialized to zero when the machine enters the print mode. The character counter 19 records the number of the character being accessed from the input buffer 14, the total number of which may be up to 256. Accordingly, N varies from 1 to 256.

The first step in printing a character is to initialize N to 0 and then increment N by one. The character which is read from the input buffer 14 is the one whose address in the input buffer 14 is N. If, at any time, character N is an end-of-line character, the line has been fully printed. Therefore, no further action need be taken, so the machine returns to the input mode.

If character N is an interword space, and if RSP is greater than zero, the mirror 30 is stepped ahead by the calculated space width plus one, i.e. SP + 1. Then, RSP is decreased by one. Otherwise, the mirror 30 will be advanced by SP spaces.

For any character, other than an end-of-line character or an interword space, the character's width is determined by adding three to the corresponding width in the ROM 18. The number (hereinafter called "RL") in the excess width counter 17 is set equal to zero. If W (after correction by adding three to the number in the ROM) is greater than 15, RL is set equal to the excess width over 15 units and W is reset to 15. W and RL are both mutiplied by the point size, PS, and the mirror 30 is advanced by W × PS, i.e. 15 PS. The character is accessed and flashed, and thereafter the mirror 30 is advanced RL × PS spaces in order to compensate for its excess width. Following each character acquisition, N is incremented by one and the next character, at the address N, is read from the input buffer 14. When an end-of-line character is read, the machine transfers back to the input mode.

Figure 9:
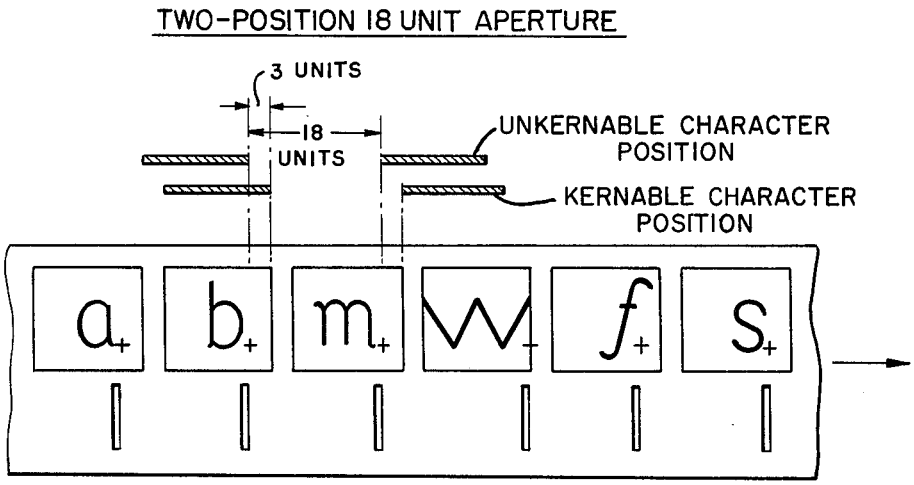
FIG. 9 is a schematic representation of one embodiment of the present invention in which a dual position aperture is used.
Figure 13:
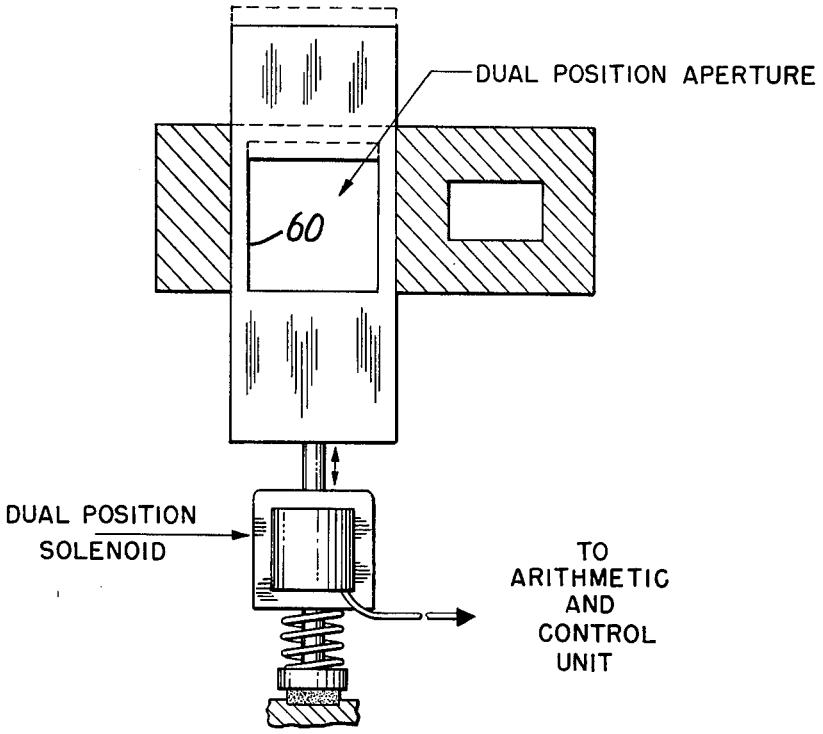
FIG. 13 is a pictorial drawing of a dual position aperture, used in conjunction with the embodiment of the invention shown in FIG. 9.

Referring generally to FIGS. 9 and 13, a first alternative embodiment of the present invention is shown. In this embodiment, a movable, dual position aperture 60 is used. The aperture is 18 units wide, corresponding tp the maximum width of a character image to be transmitted through it. The aperture has a first, position for unkernable characters (to the left as shown in FIG. 9), and a second image position (to the right as shown in FIG. 9) which is used for transmitting the images of kernable characters.

The font strip used with the embodiment of the invention shown in FIG. 9 includes typographical characters having a maximum width of eighteen relative units, equal to the width of the aperture. The typographical characters are positioned within em squares in accordance with the front strip of the preferred embodiment of the invention. A timing mark is associated, in fixed relative position, with the z-point of each em square. As in the preferred embodiment of the invention, a kerned character extends to the right of the z-point of its em square.

In the operation of a phototypesetting machine which employs the embodiment of the invention shown in FIG. 9, the flash lamp 24 is strobed to project the character's image when the z-point of the character's em square is aligned with the right edge of the aperture 60 in its normal position (whether or not the character is kerned). For kernable characters, the aperture 60 is moved to its kerned image position in order to permit the kerned portion of a character to be transmitted therethrough.

In order to distinguish between kernable and unkernable characters, the ROM associated with the font strip of this embodiment of the invention includes a flag bit to indicate whether a particular character is kernable. When a kernable character is selected, as indicated by the presence of the flag bit, the aperture 60 is moved to the right, relative to the character. Alternatively, the flag bit may be omitted and all characters having a designated width in the ROM of less than a prescribed amount may be designated as being kernable.

The aperture movement, in the embodiment of FIG. 9, eliminates the two successive mirror movements between certain character flashes which are sometimes required in the preferred embodiment. Only a single mirror movement, corresponding to the character's width, is required between character selections.

It should be recognized by one skilled in the art, that while a mechanical, dual position aperture 60 has been discussed and described in the drawings, an electronic, dual position aperture, such as a liquid crystal aperture, can be employed without departing from the spirit or scope of the invention.

Figure 10:
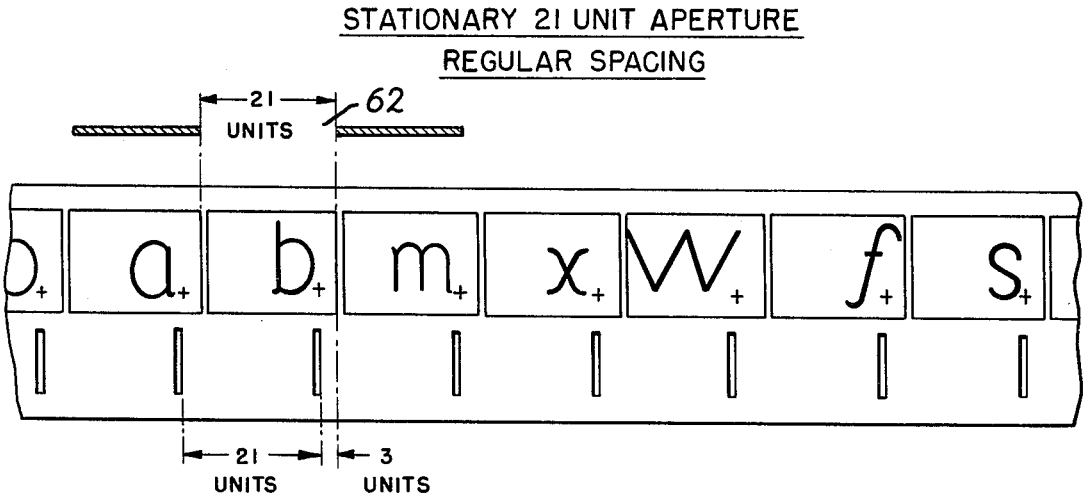
FIG. 10 is a schematic representation of another embodiment of the present invention in which the aperture is wider than the widest unkerned character by an amount corresponding to the maximum kerning permitted.
Figure 11:
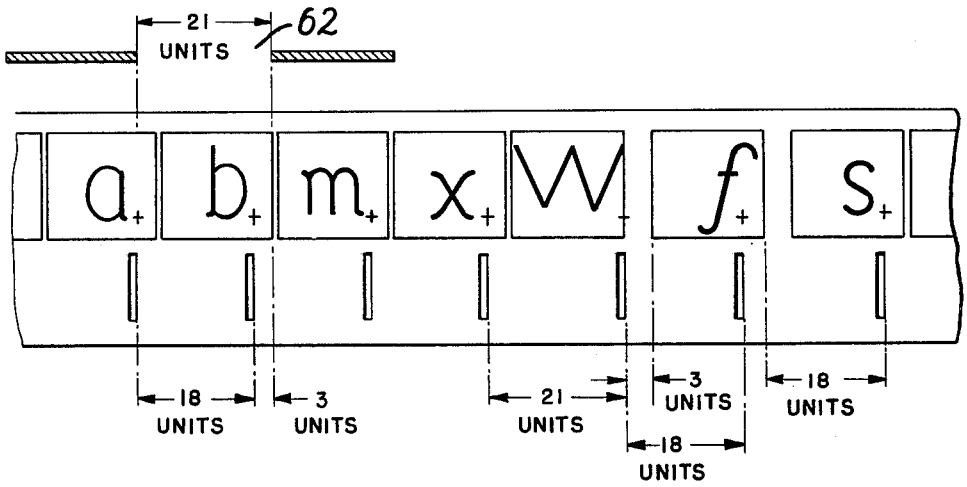
FIG. 11 is a schematic representation of a modified version of the embodiment of FIG. 10 in which variable spacing of characters on the font strip is used to save space.

Referring generally to FIG. 10, another embodiment of the present invention is shown. In this embodiment, a stationary 21 unit wide aperture 62 is used. The wide aperture is able to accommodate both unkerned characters and characters which are kerned by as much as three units.

In the embodiment shown in FIG. 10, the font strip includes a series of characters, which may be up to eighteen units wide for an unkerned character, or up to twenty-one units wide for a kerned character. A timing mark is associated, in fixed relative position, with the z-point of each em square. A character is flashed when the z-point of its em square is three relative units from the right side of the aperture. If the character is kerned, the kerned portion fits through the aperture along the right edge. Kerned characters may have a maximum width of 21 units, because the aperture is 21 units wide.

The embodiment of FIG. 10 is simpler than the previous two embodiments in that it uses a fixed aperture and is able to operate with only a single mirror movement between characters flashed. The simplification requires that a 21 unit wide image is always exposed through the aperture. A disadvantage of this embodiment is that there can be only one character for each 21 units of font strip length, rather than one character every 18 units as in the previous two embodiments of the invention. The allocation of three extra units per character means that a font strip having the same length and access rate as the other embodiments holds one-sixth fewer characters than the other embodiments.

Figure 12:
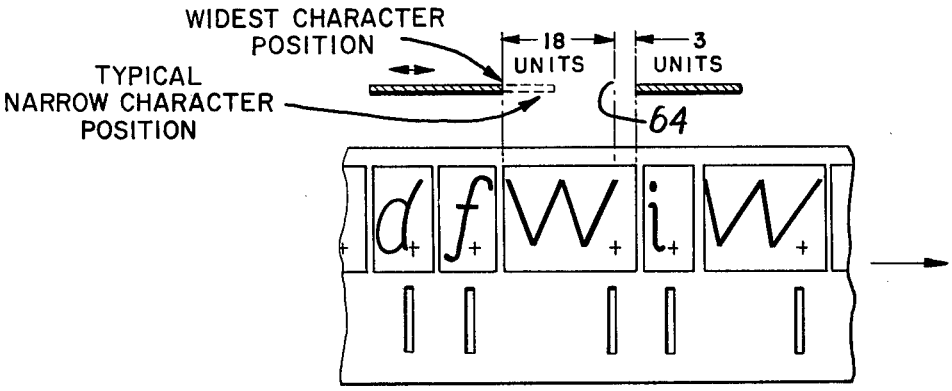
FIG. 12 is a schematic representation of yet another embodiment of the present invention in which a variable width aperture is used.
Figure 14:
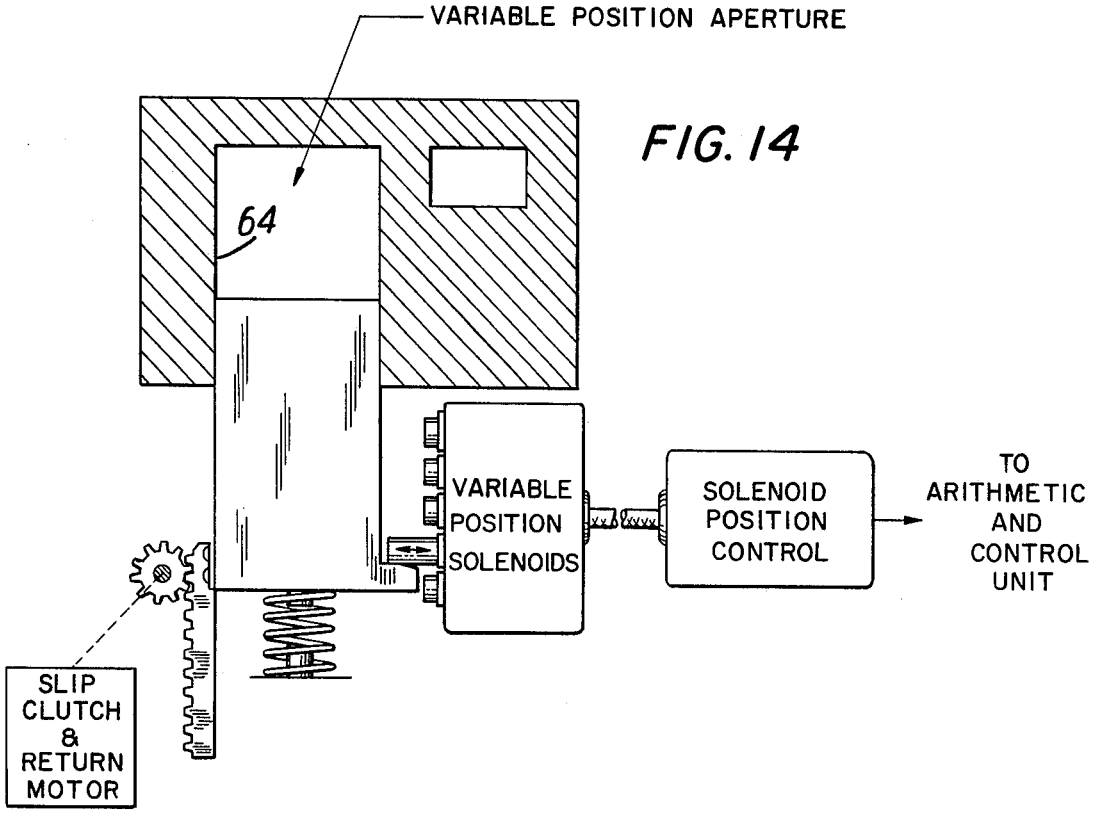
FIG. 14 is a pictorial drawing of a variable position aperture, used in conjunction with the embodiment of the invention shown in FIG. 11.

Referring generally to FIGS. 12 and 14, yet another embodiment of the present invention is shown. In this embodiment, the aperture 64 has a variable width with a fixed right edge and a movable left edge. As previously described with regard to the embodiment shown in FIG. 9, the variable position aperture 64 of this embodiment may be constructed either mechanically, as shown, or electronically, through the use of a material having electronically controlled transparency or opacity.

The font strip employed in the embodiment of FIG. 12 is laid out essentially the same as the font strip of the preferred embodiment. There is some difference, however, in that the variable width aperture is used as a mask for narrow characters. Accordingly, narrow characters on the font strip do not require a full 18 units of spacing as they do on the font strip of the preferred embodiment. Therefore, variable character spacing on the font strip is used in conjunction with the variable width aperture 64 to increase the number of characters on the font strip (without changing either the font strip length or the access rate). The electronics of this embodiment are the same as those of the preferred embodiment except that the character width information from the ROM is also used to adjust the aperture width prior to flashing each character. The aperture's width must be at least as wide as the character transmitted therethrough, plus the maximum amount that a character may be kerned.

Figure 15:
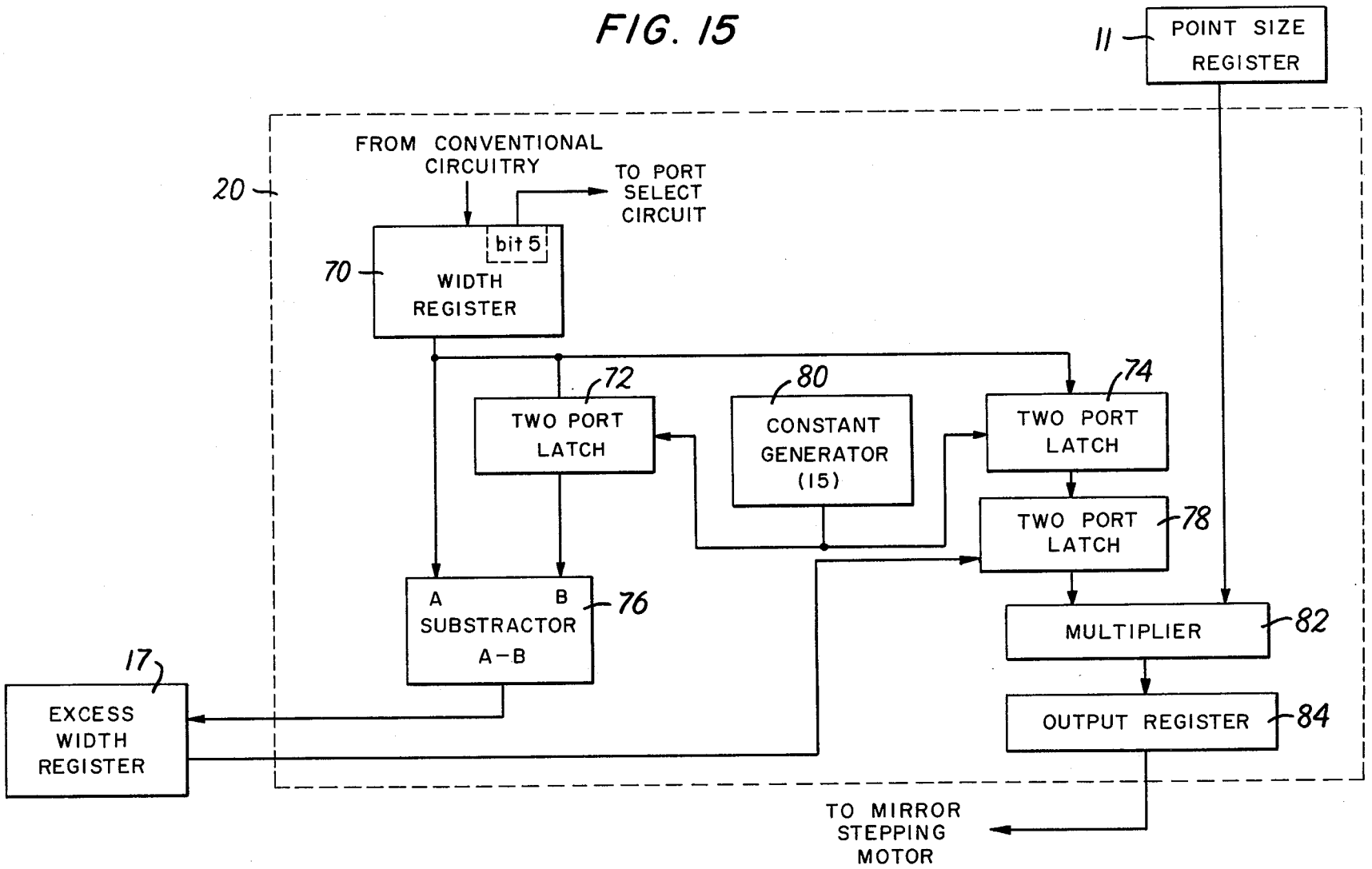
FIG. 15 is a schematic diagram of the hardware modifications required in a standard phototypesetting machine to implement the preferred embodiment of the invention.

Referring particularly to FIG. 15, and generally to FIGS. 1 and 8, a block diagram of the hardware modifications to a standard phototypesetting machine necessary to implement the present invention is shown. In particular, the diagram of FIG. 15 relates to the portion of the arithmetic and control unit 20 which is modified in order to provide the two mirror movements per character flash which is required in the preferred embodiment of the invention, as shown in FIG. 1.

In a standard phototypesetting machine, the character width which is stored in a width register is multiplied by the point size to determine the number of spaces by which the mirror 30 must be advanced, by appropriate movement of the mirror stepping motor 28, prior to flashing the discharge lamp 24. In the preferred embodiment of the present invention, however, there will be two mirror movements for characters which are more than 15 relative units wide. Accordingly, the width register 70 has an output port connected to one input port of a first two port latch 72, one input port of a second two port latch 74, and the minuend port of a substractor 76.

The output port of the first latch 72 is connected to the subtrahend port of the subtractor 76. The output of the subtractor 76 is connected to the input port of the excess width register 17, and the output of the excess width register 17 is connected to one input port of a third two port latch 78. The second input port of latch 78 is connected to the output of latch 74.

A constant generator 80 which generates the constant 15 is connected to the second input of latch 72 and the second input of latch 74.

The output of the third latch 78 is connected to one input port of a multiplier 82. The second input port of the multiplier 82 is connected to the output of the point size register 11. The output of the multiplier 82 is connected to the mirror stepping motor 28 through an output register 84.

In the operation of the phototypesetting machine 10, the presence of a 1 at bit position 5 in the width register 70 indicates that the width of the character which is to be flashed is greater than 15 units. Assuming that the character width is greater than 15 units, the first dual port latch 72 will be set to the input port connected to the constant generator 80. Accordingly, the substractor will load the excess width register 17 with the character's width in excess of 15 units.

Next, the input port of latch 74 which is connected to the constant generator 80 will be selected, and the input port to the latch 78 which is connected to the output of latch 74 wil be selected, thereby connecting the constant generator 80 to one input port of the multiplier 82. The multiplication of fifteen times the point size will be carried out by the multiplier 82, and the result will be loaded into the output register 84. Then, the output register will be decremented one unit at a time, with an output pulse to advance the mirror stepping motor 28 for each unit.

Next, the discharge lamp 24 will be strobed in the standard manner. Thereafter, the latch 78 will be switched to the input port connected to the excess width register 17, and the excess width will be multiplied by the point size. The result will be placed in the output register 84, which will be decremented one unit at a time while the mirror stepping motor 28 is advanced.

In the event that bit 5 is a 0, indicating that the character's width in the width register 70 is less than 16 units, the input port of latch 72 which is connected to the output of the width register 70 will be selected. Therefore, the character's width will be placed in both the minuend and the subtrahend input ports of the subtractor 76. The operation of the hardware will continue as heretofore described, but the excess width register 17 will be loaded with a 0 as a result of the subtraction of the character's width from itself. Obviously, the multiplication of the excess width by the point size will result in 0 being placed in the output register 84 prior to the attempted second mirror movement. Accordingly, there will be only a single mirror movement for characters having a width of less than 16 relative units.

We claim:

1. A character carrier for use in a photocomposing machine, said character carrier comprising an elongated strip of material having disposed thereon two longitudinal successions of elements aligned in laterally displaced relationship, the elements of one longitudinal succession being typographical characters and the elements of the other longitudinal succession being timing marks, there being a timing mark associated with each of the typographical characters;

said two longitudinal successions of elements having an optical transmissivity opposite to that of the remaining portion of said strip of material;

said typographical characters and associated timing marks being positioned laterally with respect to each other along said character carrier such that characters having a width which is equal to or less than a prescribed width have their right side bearings located at a fixed relative position with respect to their associated timing marks and characters having a width which is greater than said prescribed width have their right side bearings displaced to the right with respect to said fixed relative position by an amount substantially equal to the difference between the width thereof and said prescribed width.

2. The character carrier defined in claim 1 wherein said typographical characters are arranged on the said character carrier along a common base line which extends longitudinally.

3. The character carrier defined in claim 2, wherein said timing marks are located along said character carrier at regularly spaced intervals.

4. The character carrier defined in claim 2, wherein said timing marks are located along said character carrier at intervals at least as far apart as the width of their associated typographical characters.

5. The character carrier defined in claim 1, wherein each typgraphical character is arranged in an associated em square defining the character size and position, said "em" squares each having the same dimensions

6. The character carrier defined in claim 5, wherein said em squares are located along said character carrier at regularly spaced intervals.

7. A character carrier for use in a photocomposing machine, said character carrier comprising an elongated strip of material having disposed thereon two longitudinal successions of elements aligned in laterally displaced relationship, the elements of one longitudinal succession being typographical characters and the elements of the other longitudinal succession being timing marks, there being a timing mark associated with each of the typographical characters;

said two longitudinal successions of elements having an optical transmissivity opposite to that of the remaining portion of said strip of material;

said typographical characters and associated timing marks being positioned laterally with respect to each other along said character carrier such that the right side bearing of each character is located in fixed relative position with respect to its associated timing mark;

said timing marks being located along said character carrier at irregularly spaced intervals in dependence upon the width of their associated characters;

and at least one character having a kerned portion extending to the right of its right side bearing.

8. The character carrier defined in claim 7, wherein said typographical characters are arranged on the said character carrier along a common base line which extends longitudinally.

9. The character carrier defined in claim 8, wherein each typographical character is located in an associated em square defining the character size and position, the width of said em squares being dependent upon the width of their associated characters.

10. The character carrier defined in claim 9, wherein said em squares are located along said character carrier at regularly spaced intervals.

11. The character carrier defined in claim 7, wherein the spacing between two successive timing marks equals the distance between the right side bearings of the two characters with which they are associated.

12. The character carrier defined in claim 7, wherein each typographical character is arranged in an associated em square defining the character size and position, said em squares each having the same dimensions.

13. The character carrier defined in claim 12, wherein said em squares are located along said character carrier at regularly spaced intervals.

14. The character carrier defined in claim 12, wherein said em squares are located along said character carrier at irregularly spaced intervals, in dependence upon the width of adjacent characters.

15. The character carrier defined in claim 7, wherein each timing mark is located along the character carrier in transverse alignment with the right side bearing of its associated character.

16. The photocomposing machine of claim 19, further comprising:

a. means for indicating that a character selected for imaging is kerned; and b. means for moving said aperture laterally to the right by an amount corresponding to the maximum permissible kerning of a character prior to flashing a kerned character.

17. The photocomposing machine of claim 19, wherein said first predetermined amount is equal to the width of an unkerned character, wherein the width of said aperture exceeds the maximum width of any unkerned character to be projected therethrough by an amount corresponding to the maximum permissible kerning of a character, and wherein said second amount is zero.

18. The photocomposing machine of claim 19 further comprising a. a variable width aperture;

b. means for controlling the width of said aperture in accordance with the width of each character to be projected therethrough such that the aperture width exceeds the character width by an amount corresponding to the maximum permissible kerning of a character.

19. A photocomposing machine for automatic kerning of typographical characters comprising:

a. at least one character carrier for presenting typographical characters, at least one of which is kerned, to an optical system for imaging onto a sensitized medium;

b. an optical system comprising:

1. an aperture for masking all but a single portion of said character carrier to the path of light, said portion containing a single typographical character;

2. flash lamp means for projecting light through said character carrier and said aperture means;

3. image offset means for positioning the projection of light transmitted through said aperture means on the sensitized medium;

c. means for controlling said image offset means to advance the projection of character images on the sensitized medium by a first predetermined amount prior to energizing the flash lamp and by a second amount determined by the width of the projected character in excess of said first predetermined amount following the energization of said flash lamp.

* * * * *